US008531316B2

(12) United States Patent
Velado et al.

(10) Patent No.: US 8,531,316 B2
(45) Date of Patent: Sep. 10, 2013

(54) NAUTIC ALERT APPARATUS, SYSTEM AND METHOD

(76) Inventors: Nicholas F. Velado, Pflugerville, TX (US); Fernando A. Velado, Westerville, OH (US)

( * ) Notice: Subject to any disclaimer, the term of this patent is extended or adjusted under 35 U.S.C. 154(b) by 365 days.

(21) Appl. No.: 12/824,664

(22) Filed: Jun. 28, 2010

(65) Prior Publication Data

US 2011/0095914 A1 Apr. 28, 2011

Related U.S. Application Data

(60) Provisional application No. 61/255,639, filed on Oct. 28, 2009.

(51) Int. Cl.
*G08G 5/00* (2006.01)

(52) U.S. Cl.
USPC ... 340/984; 340/286.02; 340/541; 340/545.1; 726/3; 726/22; 700/2; 700/1

(58) Field of Classification Search
None
See application file for complete search history.

(56) References Cited

U.S. PATENT DOCUMENTS

| | | | | |
|---|---|---|---|---|
| 4,531,406 | A | 7/1985 | Fritz | |
| 5,078,577 | A | 1/1992 | Heckman | |
| 5,119,676 | A | 6/1992 | Bower et al. | |
| 6,469,641 | B1 | 10/2002 | Lash et al. | |
| 6,473,004 | B1 | 10/2002 | Smull | |
| 6,816,088 | B1 | 11/2004 | Knoska et al. | |
| 7,012,517 | B2 | 3/2006 | Mueller et al. | |
| 7,391,298 | B1 * | 6/2008 | Campbell et al. | 340/286.02 |
| 2002/0118102 | A1 | 8/2002 | Fundak et al. | |
| 2007/0209434 | A1 | 9/2007 | Peters | |
| 2007/0300302 | A1 * | 12/2007 | Morin et al. | 726/23 |
| 2011/0018707 | A1 * | 1/2011 | Dobson et al. | 340/539.13 |

FOREIGN PATENT DOCUMENTS

| | | | |
|---|---|---|---|
| GB | 2396729 | | 8/2002 |
| JP | 2008-252457 | A | 10/2008 |
| KR | 10-2000-0012704 | A | 6/2000 |
| KR | 20-0223261 | Y1 | 5/2001 |
| KR | 10-2003-0007269 | A | 1/2003 |
| KR | 10-0374777 | B1 | 3/2003 |

OTHER PUBLICATIONS

International Search Report, dated Feb. 16, 2011, in corresponding International Patent Application No. PCT/US2010/041696, 5 pages.

* cited by examiner

*Primary Examiner* — Tai T Nguyen
*Assistant Examiner* — Ojiako Nwugo
(74) *Attorney, Agent, or Firm* — Maier & Maier PLLC

(57) ABSTRACT

In at least one exemplary embodiment, an autonomous onboard monitoring and communications system for watercraft is disclosed. The autonomous onboard monitoring and communications system may include a processor, at least one system console, a plurality of sensors configured to monitor operating and environmental conditions aboard the watercraft, a system application including a plurality of software logic service modules configured to facilitate communication between the plurality of sensors and the system console, an analytic engine configured to analyze data so as to determine the existence of an event, and a plurality of communications interfaces for directly communicating with remote targeted recipients.

14 Claims, 13 Drawing Sheets

NAUTIC ALERT APPLICATION SERVICE LOGIC MODULE DESCRIPTIONS

| Parent Module | Service Logic Module | Service Logic Module Description |
|---|---|---|
| IGUI | Presentation & Navigation | Graphical touch-screen user presentation functional logic and navigation |
| IGUI | Setup Wizard | Non-technical user interface that guides the boat owner in the setup of the system using best practices and enforces system policies and dependencies |
| Application Logic | Analytic Engine | Analyzes system messages and sensor data and performs event analysis in an effort to eliminate false-positive messages. |
| Application Logic | Sensor Mgt. Logic | Manages the identification, additions, and removal of sensors including troubleshooting functionality |
| Application Logic | Communication Mgt. Logic | Manages alert policies, sending alerts, and alert recipient contacts |
| Application Logic | Event Mgt. Logic | Coordinates with the Analytic Engine, Communication Mgt. and Sensor Mgt. Logic and monitors for events and system changes according to policies, and manages the event database that contains reported alerts and unreported events and system changes over a period of time |
| Application Logic | Security Mgt. Logic | Manages the security of the overall system, console, wireless sensors, system access, connection access, data access, and communication. |
| Application Logic | Power Mgt. Logic | Manages and monitors power source, distribution, and power levels for the system console and wireless sensors |
| Application Logic | Video & Sound Mgt. Logic | Manages the capture of still photos, video, sound recording, and internal siren. |
| Application Logic | Power Sensor Logic | Monitors, detects, and reports AC & DC power voltage |
| Application Logic | Soft GPS Sensor Logic | Monitors, detects, and reports changes to a vessel's longitude, latitude, speed, and heading against a defined baseline called "My Location" |
| Application Logic | Motion Sensor Logic | Monitors, detects, and reports bodily motion inside the vessel's cabin when the operating mode is set to "Away" |
| Application Logic | Smoke Sensor Logic | Monitors, detects, and reports smoke |
| Application Logic | Vessel Tracking Logic | Interacts with Soft GPS Sensor logic and maintains the vessel traveled course, time, and the targeted destination. |
| Application Logic | Gas Fume Sensor Logic | Monitors, detects, and reports gas fumes in a designated compartment |
| Application Logic | Temperature Sensor Logic | Monitors and reports temperature inside the vessel's cabin and within designated compartments |
| Application Logic | Ultrasonic Water Sensor Logic | Monitors, measures, detects, and reports changes in water level against a pre-defined baseline. |
| Application Logic | Fuel Level Sensor Logic | Monitors the vessel fuel level and consumption |
| Application Logic | Map & Weather Logic | Software logic responsible for providing nautical maps and weather services |
| Application Logic | Remote Application Logic | Software logic that resides on Nautic Alert® wireless device |
| Application Logic | Coordinator Custom Logic | Manages the communication between the wireless sensors and the system console |
| Application Logic | Remote Coordination Logic | Coordinates with Communication Mgt., Event Mgt., and Security Mgt. upon receiving alert receipts and remote requests for changes to critical features such as operating mode from a boat owner's cell phone, or request for data from a device running a Nautic Alert® Portal |
| Application Logic | Application Programming Interface (API) | Proprietary software that interfaces with specific Operating System APIs |
| Application Logic | Device Drivers | Proprietary software that enables the Nautic Alert® System Application to communicate with the Nautic Alert® hardware via the Operating System |

*Fig. 6*

NAUTIC ALERT APPARATUS, SYSTEM AND METHOD

CROSS-REFERENCE APPLICATIONS

The present invention claims priority under 35 U.S.C. §119(e) to U.S. Provisional Patent Application No. 61/255,639, filed on Oct. 28, 2009, the disclosure of which is incorporated by reference herein in its entirety.

BACKGROUND

Today, many people own a boat or other nautical vessel. Often times an owner keeps the boat or vessel at a marina, harbor, dock, trailer, other suitable location away from a home residence, or even at a home residence. Many of these places do not have security or monitoring services. Due to this lack of security or monitoring, many boats and vessels are susceptible to various risks of damage when left unattended, including, for example, high-levels of water in a boat, smoke, gas fumes, unexpected movement of an anchored boat, and unexpected movement of a boat from its dock or trailer. The resulting damage from these events can be large. Moreover, boats are often stored in close proximity to many other boats increasing the potential risk for more damage. The ability to efficiently monitor, detect, alert, and respond to these types of events becomes the key to minimizing damage in the boating world.

Certain known solutions to the above-described issues may involve on-board monitoring systems. Many such solutions typically reference a land-based data center, land-based remote site, land-based network operations center, or land-based center of operations, or remote land-based website, which is typically understood in the art to be a data processing point for information, controlled and facilitated at least by computer hardware, operating systems, applications, storage, and communication networks.

Generally, vessel monitoring systems include a telemetry type of device or a device with a microprocessor installed on a vessel that is used to capture a data point value (for example, an "On" or "Off" value or a "0" or "1" value) from a sensor. Typically such devices can receive data points from onboard sensors and subsequently forward it to a land-based center via wireless communications for data processing. In turn, the land-based center applies algorithms to the received data so as to analyze the data and determine the existence or non-existence of a problem. The land-based center may then notify the owner of the vessel that a problem exists and pursue further courses of action to resolve the problem. A typical model for such vessel monitoring systems that are known in the art is shown in FIG. 1. However, such vessel monitoring system's depend on land-based computer systems and therefore the vessel onboard telemetry device cannot bypass the land-based center for the purposes of data processing and communicating alerts or information to the vessel owner. The requirement of routing all operations through and cooperating with the land-based center restricts or limits the ability to offer onboard functionality in an efficient manner. In addition, the dependency on the land-based center means that the vessel's onboard telemetry asset is not standalone nor independent, which limits the asset's ability to solve or mitigate the vessel owner risks autonomously; hence, mitigation of vessel owner risks and solution of any existing problems according to the known art requires that the onboard telemetry device and the land-based computers work together as one system to complete key core processes that address the risks and existing problems.

SUMMARY

At least one exemplary embodiment described herein includes a nautic alert method, system and apparatus. In the exemplary method, system and apparatus, an intelligent, interactive embedded computer system may monitor, detect, analyze, or alert a vessel owner, harbormaster, or a service provider of user selected boat events, conditions, statuses, trends, or event history through hardware and software. The method, system and apparatus may minimize false-positive alerts, and may efficiently detect potential hazard and alert a user.

In the exemplary embodiment, as shown in FIG. 2, the nautic alert method, system and apparatus may operate as an onboard autonomous and independent system and may not have a dependency on a land-based center or computer. The method, system and apparatus may further be configured to present enhanced reports to a vessel owner via a mobile device or a remote computer, and to present information related to online nautical and standard maps, weather, fuel level usage and consumption, vessel speed, vessel location, and the vessel's traveled course. Such information may be presented while onboard the vessel, or via a remote computer, display or mobile device. The method, system and apparatus may further be configured to not operate on a subscription-based system for provision of reports, information, and certain information that is described herein.

Furthermore, in the exemplary embodiment, the nautic alert system, method, and apparatus may place the required logic, intelligence, and capability to solve and mitigate risks onboard the vessel in an integrated and autonomous fashion. The nautic alert system, method, and apparatus may allow the system to monitor, detect, analyze, present information, and communicate directly with the vessel owner or other desired targets, while the owner or other desired targets are onboard the vessel or while they are away from the vessel. The nautic alert system, method, and apparatus may eliminate the need for a land-based center to complete key core processes. The nautic alert system, method, and apparatus may processes data onboard the vessel and may make decisions onboard the vessel based on defined policies, application logic, and the nautic alert analytic engine and process analysis method.

BRIEF DESCRIPTION OF THE FIGURES

Advantages of embodiments of the present invention will be apparent from the following detailed description of the exemplary embodiments thereof, which description should be considered in conjunction with the accompanying drawings in which:

FIG. 6 is an exemplary listing of nautic alert application service logic module Descriptions;

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description, discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the invention," "embodiments" or "invention" do not require that all embodiments of the method, system or apparatus include the discussed feature, advantage or mode of operation.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Figure 3:
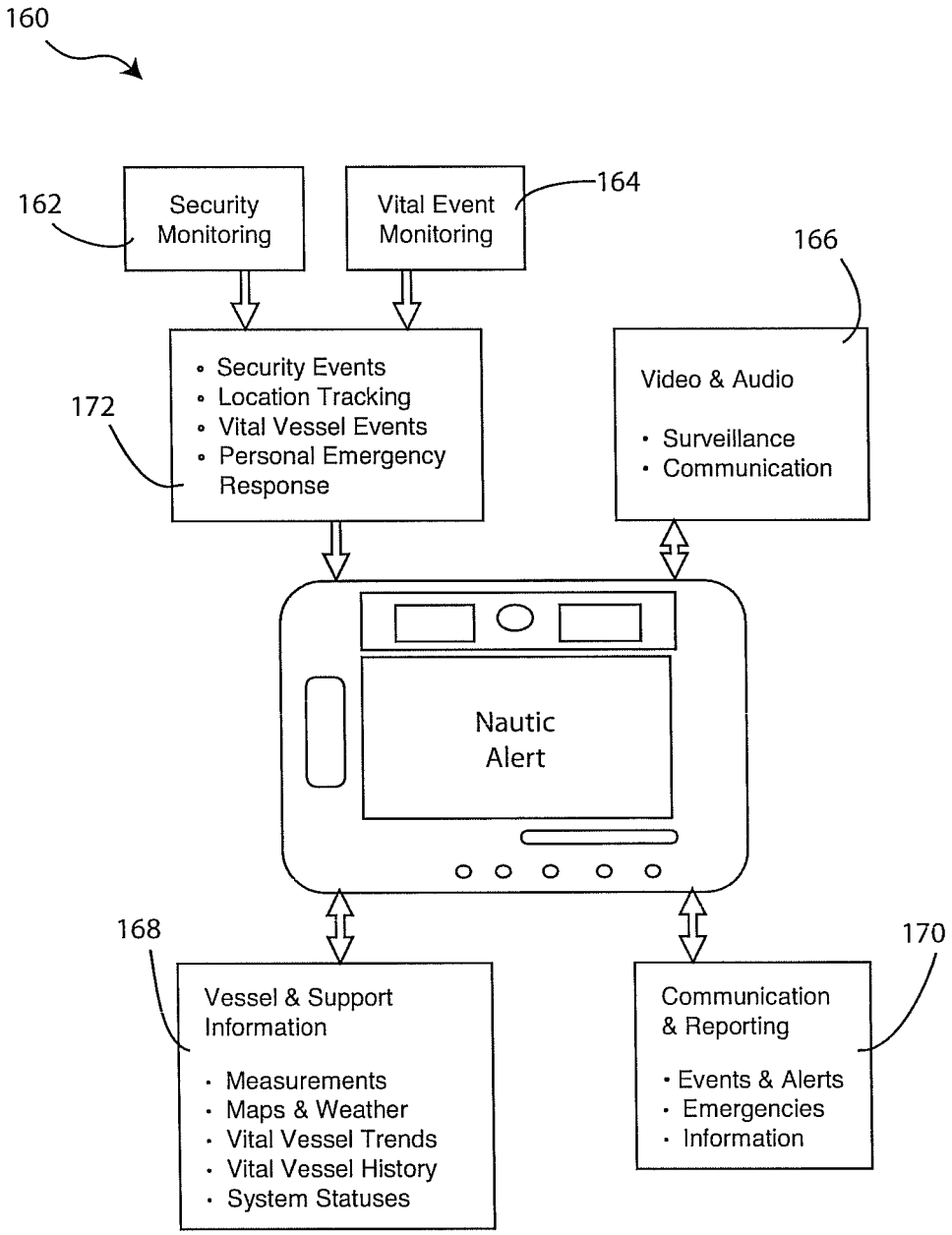
FIG. 3 is an exemplary nautic alert system overview.

FIG. 3 shows an overview of an exemplary embodiment of a nautic alert system 160. System 160 may be a dedicated, integrated, and self-contained system. As shown in FIG. 3, nautic alert system 160 may include, but is not limited to, several major areas of functionality, including security monitoring 162, vital event monitoring 164, video and audio 166, vessel and support information 168, and communication and reporting 170.

Security monitoring 162 and vital event monitoring 164 functionalities may address certain boat owner risks. To that end, security monitoring 162 and event monitoring 164 may include observing certain events and conditions 172. Such events and conditions 172 may include, but are not limited to, security events, vessel location tracking, vital vessel events, and personal emergency response needs. Video and audio support 166 functionalities may include surveillance and communication capabilities, for example and not limited to, surveillance of a vessel bridge or a specific compartment, or video conferencing. Vessel and support information 168 functionalities may include monitoring and analyzing, as an example and not limited to hereto, bilge water level measurements, fuel level measurements, traveling speed measurements, engine related measurements, and other types of measurements. Vessel and support information 168 functionalities may also provide, as an example and not limited to, nautical maps, standard maps, weather information, vital vessel trends, vital vessel history, and system statuses. Communication and reporting 170 functionalities may provide the ability for, as an example and not limited to, delivery of events and alerts to targeted recipients, requests to targeted individuals or entities for help or assistance, and two-way information exchange between the nautic alert system and targeted individuals or entities.

Nautic alert system 160 may be an intelligent system that may utilize an analytic engine 87 (shown in FIG. 8) to perform analyses of sensor data points, and to perform event analyses in an effort to eliminate false-positive messages and to promote proactive behavior that may help mitigate various disasters and events. Sensor events may be fed into analytic engine 87, which may evaluate the event against an alert policy, and may give additional feedback about a critical event, for example, whether the event has gone beyond critical or back to a normal state. A critical event may also be evaluated over a period of time as having become "worse" or "better," for example, by reporting and measuring quantitative data from a sensor. To successfully monitor, detect, analyze, and issue alerts, system 160 may include the following hardware and software:

| Hardware | Software |
|---|---|
| System Console with digital logic board (motherboard) with CPU and Memory | Nautic Alert ® Application Logic |
| System Console with Touch-Screen LCD | Nautic Alert ® Intuitive Graphical User Interface |
| Tri-Band GSM 900/1800/1900 MHz, and Quad-Band GSM 850/900/1800/1900 MHz; Dual Band CDMA 824-849/869-894 MHz, and 1850-1910/1930-1990 MHz 1XRTT for U.S. and International Cellular Communication | Nautic Alert ® API Interfaces |
| Cellular Antenna | Nautic Alert ® Device Drivers |
| GPS Antenna | Nautic Alert ® Mobile Portal |
| Wi-Fi | |
| Integrated System Console Power Sensor | Nautic Alert ® Harbor-Master Portal |
| Integrated System Console GPS Receiver | Nautic Alert ® Service Provider Portal |
| Integrated System Console Motion Detector Sensor | Nautic Alert ® Fleet Vessel Management Portal |
| Integrated System Console Speaker | SQL Compatible Database |
| Integrated System Console with Camera, Siren, and Microphone | |
| Integrated System Console Temperature Sensor | |
| Wireless AC Volt Sensor with DC Power | |
| Wireless DC Volt Sensor with DC Power | |
| Wireless Motion Detector with DC Power | |
| Wireless Smoke and Carbon Monoxide Detector with DC Power or AC Power | |

-continued

| Hardware | Software |
|---|---|
| Wireless Gas Fume Detector with DC Power | |
| Wireless Compartment Temperature Sensor with DC Power | |
| Wireless Ultrasonic Waterproof Water Level Sensor with DC Power | |
| Wireless GPS Sensor | |
| Wireless Emergency Response Device | |

Figure 5:
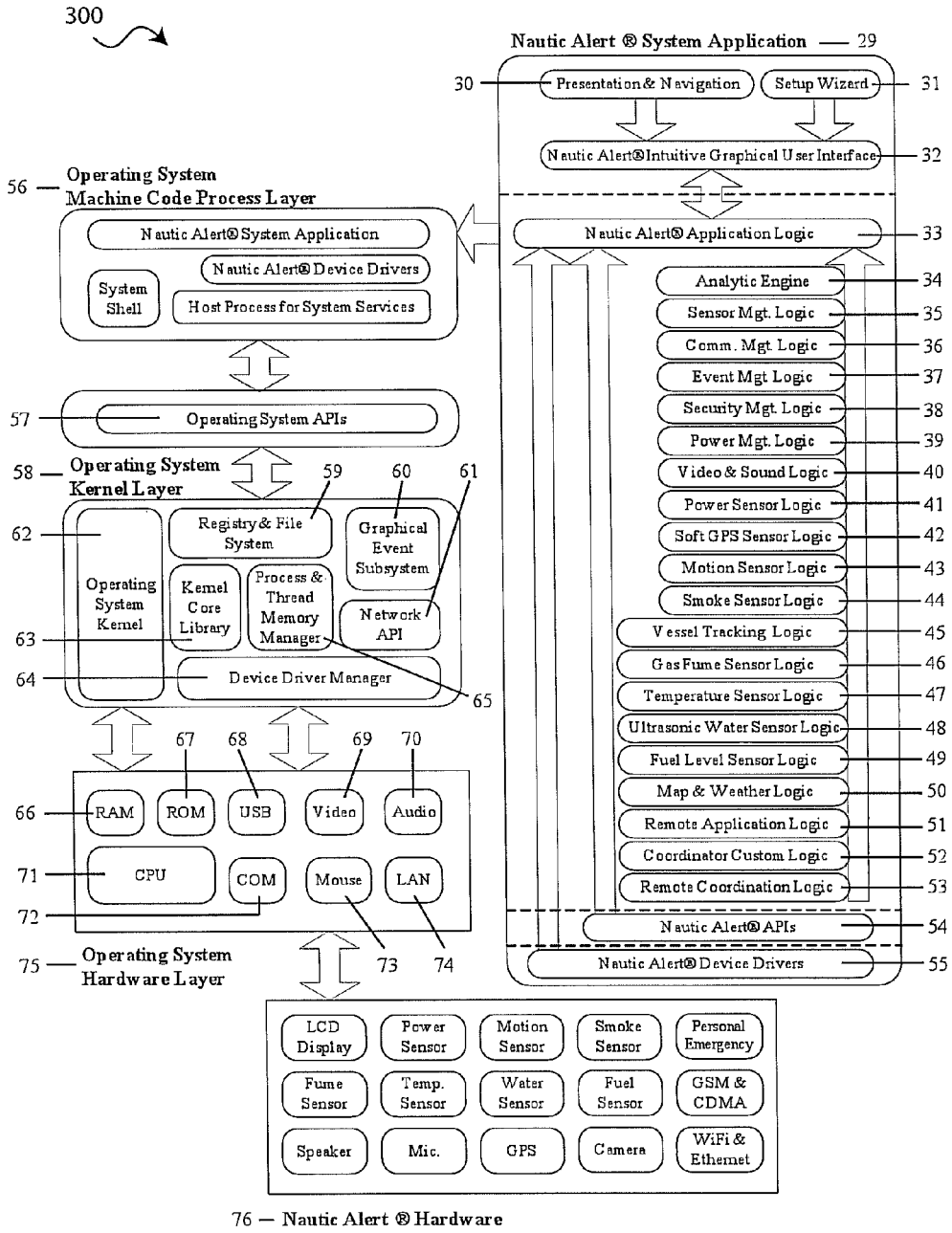
FIG. 5 is an exemplary diagram of a nautic alert system console architecture.

In one exemplary embodiment, as shown in FIG. 5, a system architecture 300, such as the Nautic Alert Architecture, may be composed of hardware and software that may create an intelligent, interactive embedded system 160 that may monitor, detect, analyze, or alert a vessel owner, harbormaster, or service provider, of events that may require attention or immediate response. The boat owner may interact with system 160 by way of an Intuitive Graphical User Interface (IGUI) 32, such as the Nautic Alert Graphical User Interface, which may be displayed on a touchscreen 2 for easy navigation. The IGUI layer 32 may communicate with an application logic layer 33, such as the Nautic Alert Application Logic layer. Application logic layer 33 may contain core system algorithms. By way of the operating system, a system application 29, such as the Nautic Alert System Application, may communicate with system hardware 76, such as the Nautic Alert Hardware. System architecture 300 may include support for wireless sensors, such as Nautic Alert Wireless Sensors. The System may identify a genuine wireless sensor from a foreign wireless sensor as a function of security management logic 38. Encrypted communication may take place between system console 200 and the wireless sensors.

System 160 may be an interactive system. Interaction may take place from a system console 200 or from mobile devices, such as, for example, a cell phone, smartphone, laptop computer or personal digital assistant ("PDA"). Event messages may be sent utilizing Short Message Service ("SMS") standards for notification. Overview of statuses, trends, historical data, and forensics may be facilitated through a portal, such as the Nautic Alert Portal, and changes to the operating mode or settings may be accomplished through system console 200 or from a mobile device. The portal and system console 200 may communicate using the wireless markup language (WML) over short message service (SMS) or WML with the wireless application protocol (WAP).

Figure 4:
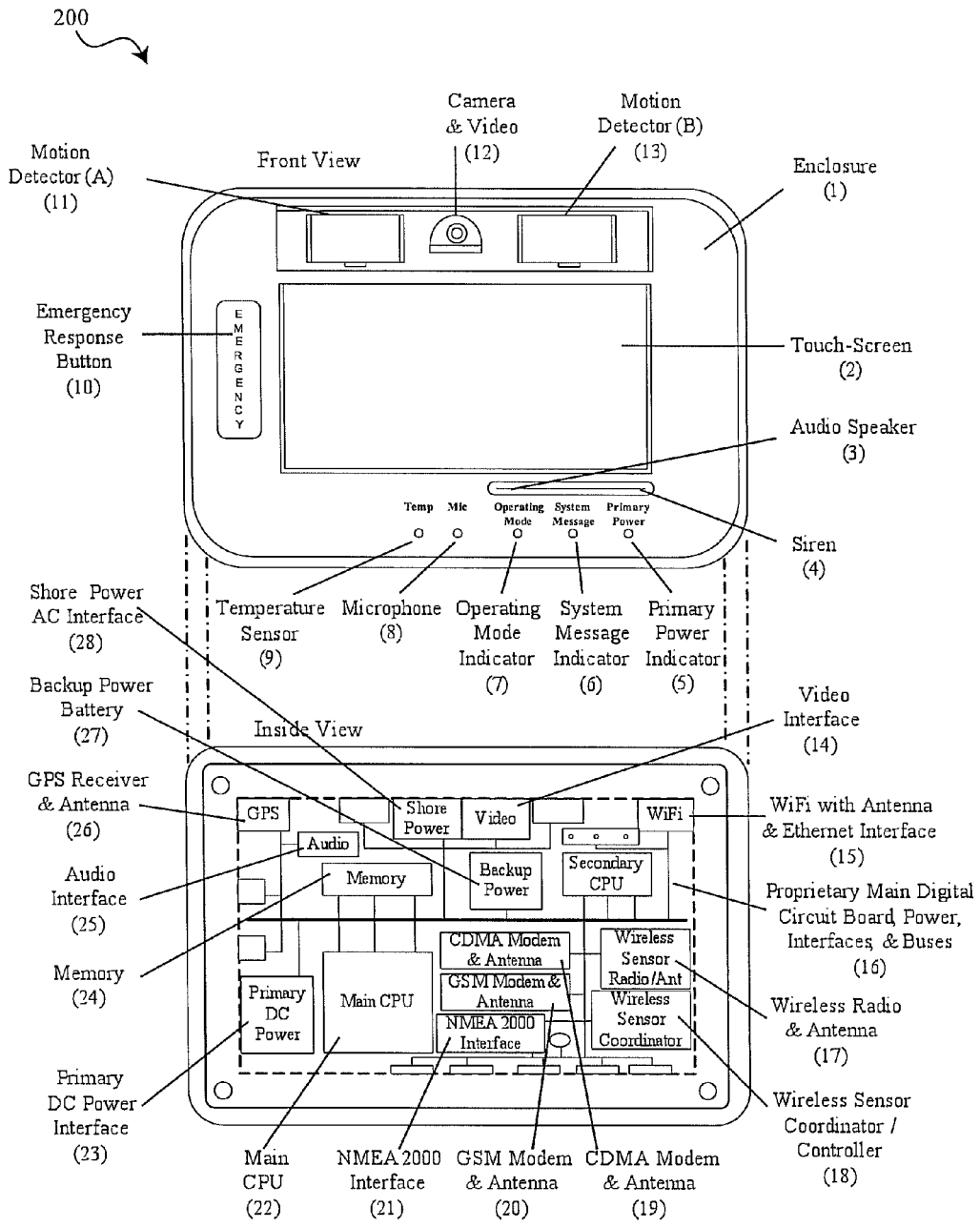
FIG. 4 is an exemplary diagram of a nautic alert system console.

In one exemplary embodiment, nautic alert system 160 may include a system console 200, as shown in FIG. 4. System console 200, such as the Nautic Alert System Console, may contain a Central Processor Unit (CPU) 22 integrated into printed circuit boards (motherboard) with integrated memory and buses 16, which may operate on direct current ("DC") power via a DC power interface 23, or on alternating current ("AC") power via a shore power interface 28, and may have an internal battery backup power source 27 and management. Application logic level software 33, such as Nautic Alert® Application Logic level software, may communicate with an IGUI 32 such as the Nautic Alert® IGUI, with electronic components on the motherboard 16, and with sensors. Application logic level software 33 can thus be the logic engine and algorithm software that facilitates the functionality of system 160.

Console 200 may be mounted in a vertical position to a bulkhead, fastened to a stand, set into an instrumentation console, set into a panel, installed inside a cabinet, locker, or other type of location. Console 200 may use a touch-screen 2 coupled with the IGUI 32, which may enable the user to interact with system application 29. IGUI 32 may produce summarized information in an executive summary, or in details, and may guide the end-user to targeted areas that may need attention or present risk. The IGUI 32 may also include an embedded "Help" system that may aid the customer in answering system related questions.

Console 200 may include an enclosure 1, and an embedded audio speaker 3 that can facilitate making two-way voice calls and can act as a receiver for an intercom system. Console 200 may also include a siren 4, which can emit variable pitch sounds as system warnings or as certain events arise onboard the vessel. Console 200 may also include a primary power indicator 5, which can show color status notifications for primary power on, primary power off, or a problem with power. Console 200 may further include a system message indicator 6, which can show color status notifications for system messages that indicate no messages, messages that requires immediate action, or messages that are proactive in nature. Console 200 may further include an operating mode indicator 7, which can show color status notifications for whether system 160 is operating in an "onboard" mode (that is, system 160 is operating in a configuration optimized for when the vessel owner is onboard), or in an "away" mode (that is, system 160 is armed and operating in a configuration optimized for when nobody is onboard the vessel and the vessel is closed and secured). Console 200 may further include a microphone 8, which can allow two-way conversations, one-way conversations as part of an intercom configuration, to facilitate listening for intruders, or for surveillance purposes. Console 200 may also include a temperature sensor 9 which can measure ambient temperature in the vicinity of console 200. Console 200 may also include an emergency response button 10 which, when depressed, can display on touch-screen 2 a selection of pre-programmed emergency situations. Selecting a pre-programmed emergency situation can initiate contact with and communicate desired actions and conditions to desired targets or entities. Console 200 may also include at least two integrated motion detector sensors 11, 13 that can detect bodily motion when the operating mode 7 is set to "away." Motion sensors 11, 13 can also be disabled through user configuration options within the system application 29. When one or both of the motion detector sensors 11, 13 detect bodily motion, the sensor can interact with motion sensor logic 43, which may in turn make a call to the analytic engine 87 for analysis and appropriate execution of logic based on system policies 88, user policies 89, and on analysis process model 500 shown in FIG. 8. Console 200 may also include an integrated camera 12 that can capture still pictures or video within the targeted area and that can interface with video and sound logic 40 through device driver manager 64. Viewing of the targeted area can occur directly on the touch-screen 2 or can occur from a remote location using a mobile device or remote computer. Console 200 may also include an integrated Global Positioning System (GPS) receiver and integrated antenna 26, a WiFi® interface and integrated antenna 15, a Global System for Mobile Communication (GSM) wireless modem and integrated antenna 20, a Code Division Multiple Access (CDMA) modem and integrated antenna 19, a wireless sensor coordinator/controller 18 for the nautic alert wireless devices, and a wireless sensor radio and integrated antenna 17 that can interface at the operating system hardware layer 77 with wireless sensor layer 84.

Console 200 may further include a proprietary main digital circuit board, power interface, and other interfaces and buses 16, which may facilitate interconnecting the components of console 200. Such components may include, but are not limited to, CPU 22, memory 24, WiFi® 15, modems 19, 20, video interface 14, audio interface 25, wireless coordinator/controller 18, wireless radio 17, and all other identified electronic components depicted in FIG. 4. The components may interact with each other through the proprietary main digital circuit board, power interface, other interfaces, and buses 16, and with the system application 29. As an illustrative and non-limiting example, such communication may also utilize various methods such as GSM 20, CDMA 19, WiFi® 15 to wireless satellite services, WiFi® 15 to wireless broadband services, wired Ethernet to satellite services, and wired Ethernet to broadband services. System application 29 may be configured to seamlessly auto-switch between any provided integrated wireless communication methods in an effort to mitigate the risk of an unavailable or problematic wireless connection for communication to a set of targeted recipients or services, and to use all available options to increase communication reliability.

Active features of console 200 and system 160 may be based on the operating mode of system 160 and on user activated features. Possible operating modes may include at least an "onboard" operating mode and an "away" operating mode. The onboard mode may be used when the vessel owner or other desired individuals are onboard the vessel. In this mode, the motion detectors 11, 13, 131, camera 12, and microphone 8 may be disabled, and wireless sensor settings for the onboard mode may default to a different set of thresholds. Such thresholds may account for the vessel being in operation, and can eliminate false-positives due to environmental changes such as the vessel moving or from vessel operation. When the vessel owner or other individuals are no longer onboard or when the vessel is secured in a port, the operating mode can be set to "away." In the away operating mode, motion detectors 11, 13, 131, camera 12, and microphone 8 may be enabled, and the wireless sensor settings set for the away operating mode may be activated. This may disable, change or otherwise modify the active thresholds established under the onboard mode. The operating mode may be changed from system console 200 or from the vessel owner's cell phone or other mobile device.

System console 200 may be powered by direct current ("DC"), and may have a DC power interface 23, which can interface with the vessel's DC power. Console 200 may further include a secondary alternating current ("AC") power interface 28, which can interface with "shore" power, that is, power from sources external to the vessel. The voltage levels for both DC power interface 23 and AC power interface 28 may be measured continuously by the power management logic 39 of system application 29, and such measurements can be reported to analytic engine 87. Console 200 may also include a backup power battery 27, which may be utilized in the event that both DC power and AC power are lost. Backup power battery 27 may therefore enable console 200 to continue operating for an a period of time after loss of power.

System console 200 may also include a National Marine Electronics Association 2000 ("NMEA 2000") interface 21 for facilitating compliance with electrical and data specifications protocols for a marine data network that is used for communication between other NMEA 2000 compliant marine electronic devices. Such devices may include, but are not limited to, navigation instruments, depth finders, engine sensors and instruments, tank level sensors, and other applicable type of devices. The NMEA 2000 interface 21 can support a hardwired connection or can be accessed through the Zigbee®/NMEA 2000 wireless bridge. The Nautic Alert intelligent wireless sensors can operate on a dedicated Controller Area Network ("CAN") bus, and can utilize the NMEA 2000 protocol that resides on top of the CAN bus. The CAN bus may interact with the intelligent wireless sensor architecture 400 at the physical layer 79, at the Media Access Control (MAC) layer 80, and at the ZigBee® data link controller layer 81. That is, the Nautic Alert intelligent wireless sensors may connect directly to the CAN bus through a NMEA 2000 hardwire interface or may connect to the CAN bus through a wireless Zigbee®/CAN bridge.

FIG. 5 shows an exemplary embodiment of a system console architecture 300 and the software logic service modules that may be included in system application 29. An exemplary, but not limiting list of such service logic modules is shown in FIG. 6. System application 29 may include, but is not limited to, intuitive graphical user interface (IGUI) 32, application logic 33, application programming interfaces ("APIs") 54, and device drivers 55.

IGUI 32 may include, but is not limited to, presentation and navigation logic 30 and setup wizard logic 31. Application logic 33 may include, but is not limited to, analytic engine 34, sensor management logic 35, communication management logic 36, event management logic 37, security management logic 38, power management logic 39, video and sound logic 40, power sensor logic 41, soft GPS sensor logic 42, motion sensor logic 43, smoke sensor logic 44, vessel tracking logic 45, gas fume logic 46, temperature sensor logic 47, ultrasonic water sensor logic 48, fuel level sensor logic 49, map and weather logic 50, remote application logic 51, coordinator custom logic 52, and remote coordination logic 53.

System application 29 may run on top of a commercial operating system within the operating system machine code process layer 56 and may interface with the operating system APIs 57 utilizing APIs 54 of system application 29. System application 29 may interface with the operating system kernel layer 58 via the operating system kernel 62, which may contains kernel core library 63. Kernel core library 63 may provide functionality such as, but not limited to, registry and file system management 59, memory management, process loading, scheduler, process and thread memory management 65, graphics, graphic windowing, and graphic event subsystem 60, network APIs 61, and device driver management 64.

CPU 71 may interact with the system application 29 by fetching the application instructions, which may be stored in random access memory RAM 66 and in read only memory ROM 67 by the process and thread memory manager 65 of the operating system kernel 62. CPU 71 may return a set of results from processing system application 29 instructions to the operating system kernel 62, which in turn may result in completed instructions, data, or new instructions to be processed by the CPU 71. The application logic results may then be made visible to a vessel owner or user, for example, in graphical form, in specific actions, in data, in messages, in alerts, in reports and in other forms and methods.

Device drivers 55 may interact with operating system device driver manager 64 at operating system kernel layer 58 and operating system hardware layer 75. Such interaction may be facilitated via interfaces such as video 69, audio 70, mouse 73, USB 68, COM 72, and LAN 74, thereby resulting in direct communication with hardware 76 and the intelligent wireless sensors.

System 160 may include integrated sensors and devices, which may include the following:

| Name | Type | Function |
|---|---|---|
| Camera | Integrated Device | Captures still images or video inside the targeted vessel area as requested by the boat owner via the Mobile Portal or by policy |
| CDMA Modem | Integrated Device | Enables Nautic Alert to communicate using a CDMA cellular network |
| Global Positioning System (GPS) Receiver and Soft GPS Sensor | Integrated Device | Provides navigation data such as longitude, latitude, speed, and heading - and detects changes to the baseline |
| GSM Modem | Integrated Device | Enables Nautic Alert to communicate using a GSM cellular network |
| Internal DC Power Sensor | Integrated Sensor | Monitors and measures the voltage of the Nautic Alert ® system console primary DC source and health of the internal backup power source |
| Internal AC Power Sensor | Integrated Sensor | Monitors and measures the voltage of the Nautic Alert ® system console primary AC source |
| LCD Touch-Screen | Integrated Device | Monitor that displays the Nautic Alert ® Intuitive Graphical User Interface and enables touch-screen navigation |
| Microphone | Integrated Device | Records sound or aids in two-way communication |
| Motion Detector | Integrated Sensor | Detects bodily motion |
| Personal Emergency Response | Integrated Device | Alerts targeted entities, organizations, or individuals of a personal emergency onboard the vessel |
| Speaker | Integrated Device | Emits audio sounds resulting from specific events |
| Temperature | Integrated Sensor | Measures temperature within a targeted area |
| Wi-Fi | Integrated Device | Enables Nautic Alert to interface and communicate through satellite networks and other types of broadband services |

System 160 may include wireless sensors and devices, which may include the following:

| Name | Type | Function |
|---|---|---|
| AC Volt Sensor | Wireless Sensor | Detects the presence of AC voltage, which is considered to be "Shore" power |
| DC Volt Sensor | Wireless Sensor | Measures voltage for a specific battery bank |
| Fuel Level | Wireless Sensor | Ascertains vessel fuel level |
| Gas Fume Sensor | Wireless Sensor | Detects gas fumes in a targeted compartment |
| GPS Sensor | Wireless Sensor | Provides all required navigation data such as longitude, latitude, speed, and heading - and detects changes to the baseline. Designed to be mounted on or near window for strong signal. |
| Motion Detector Sensor | Wireless Sensor | Detects bodily motion inside a specific compartment |
| Personal Emergency Device | Wireless Sensor | Alerts others of an onboard personal emergency situation |
| Smoke Detector and CO Sensor | Wireless Sensor | Detects smoke and carbon monoxide in a designated compartment |
| Temperature Sensor | Wireless Sensor | Provides temperature reading for a designated compartment |
| Water Level Sensor and Switch | Wireless Sensor | Measures the water level at the bottom of a vessel's bilge compartment using ultrasonic technology, and can turn a bilge pump "on" or "off" |

The wireless sensors, with the exception of the alternating current (AC) power sensor, may be direct current (DC) powered devices, with internal backup battery power. The water level and DC power sensors may obtain their primary power from the vessel's DC system. The AC power sensor may have an internal backup power supply, with a primary power source from the vessel's AC shore power.

Figure 7:
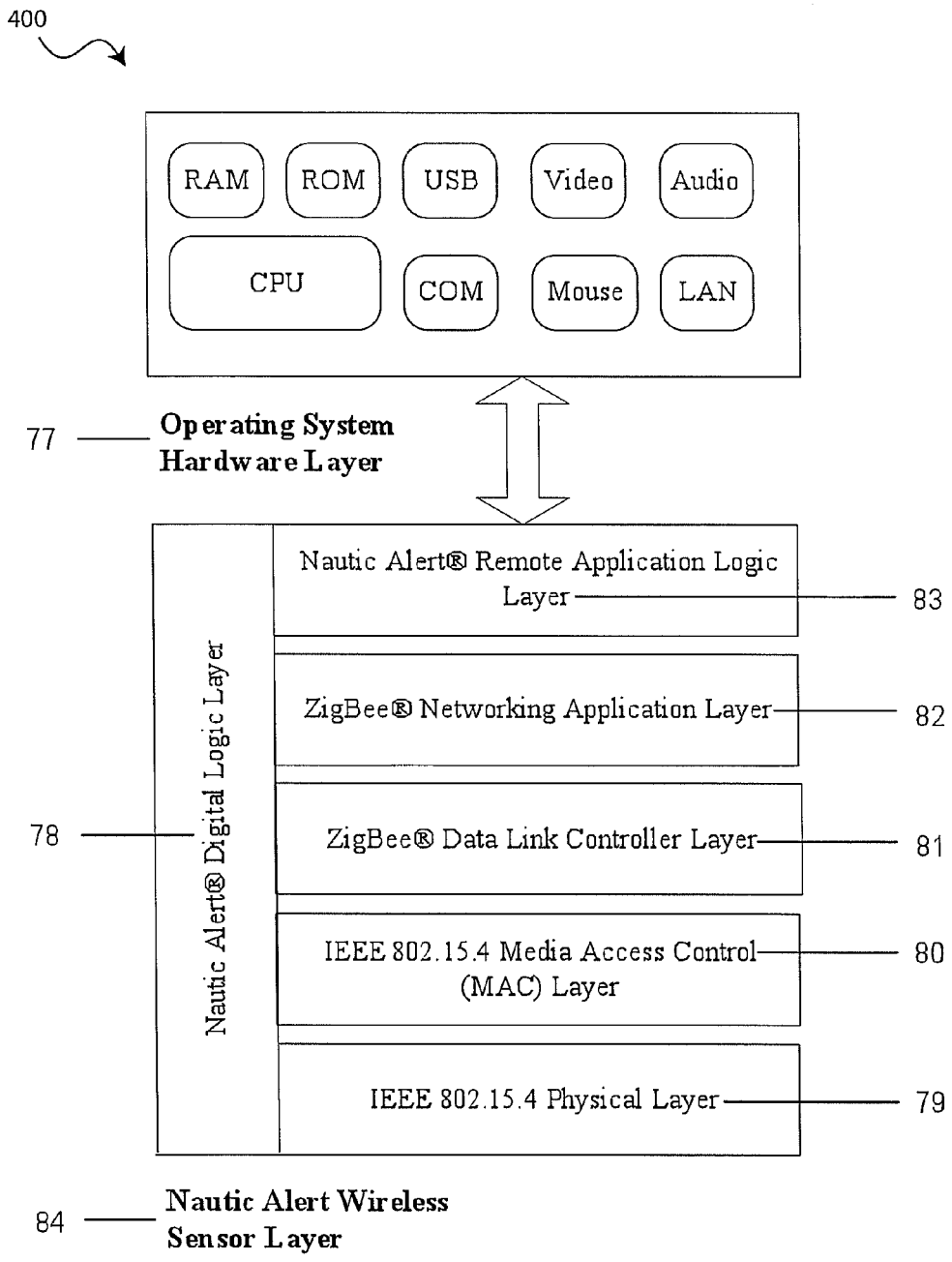
FIG. 7 is an exemplary diagram of a nautic alert intelligent wireless sensor architecture.

Turning to FIG. 7, system 160 may include an intelligent wireless sensor architecture 400, which in turn may include an operating system hardware layer 77 and a wireless sensor layer 84. Wireless sensor layer 84 may include digital logic layer 78, IEEE 802.15.4 physical layer 79, IEEE 802.15.4 media access control (MAC) layer 80, ZigBee® data link controller layer 81, ZigBee® networking application layer 82, and remote application logic 83. The above-listed components of wireless sensor layer 84 can facilitate the exchange of data and application instructions between remote application logic layer 83 and system application 29.

Digital logic layer 78 may include a digital circuit board, power interface, other interfaces, and buses, and may facilitate interconnecting the electronic components of the wireless sensor units such as wireless radios, interfaces, memory, capacitors, relays, and other electronic components that enable system 160 to function as described herein.

The upper level of the communication protocol suite may be based on the ZigBee® communication protocol, which may provide network layer 82 and data link layer 81 of the communication protocol. The lower level of the communication protocol suite may include physical layer 79 and Medium Access Control (MAC) layer 80, and may be based on the IEEE 802.15.4 wireless data transfer standard.

System application 29 and remote application logic 83 may include application-level logic that can enable application-level communication functionality between the system console 200 and the intelligent wireless sensor devices. Such functionality may be separate and distinct from the ZigBee® upper level communication protocol suite. The application-level communication logic may include the following capabilities and functionalities: (1) a proprietary application level communication protocol; (2) enhanced security measures to prevent against non-trusted communication; (3) future scalability that can allow support for an NMEA-2000-to-Nautic-Alert bridge and interface, wherein a physical wireless sensor can act as though it contains multiple sensors that may be located on another physical medium; (4) an enhanced automatic error recovery and additional security algorithms supporting dynamic frequency hopping and dynamic network ID change capability; (5) an ability to reset coordinator ID to automatically recover a Nautic Alert intelligent wireless sensor that may have initially bound to another coordinator; and (6) an ability to set update rate based on aggressive reporting or conservative battery consumption.

Remote application logic 83 may support the functional application and purpose of each unique intelligent wireless sensor. The intelligence within each wireless sensor may be established by the interaction of remote application logic 83, analytic engine 87 and analysis process model 500, as shown in FIG. 8.

Figure 8:
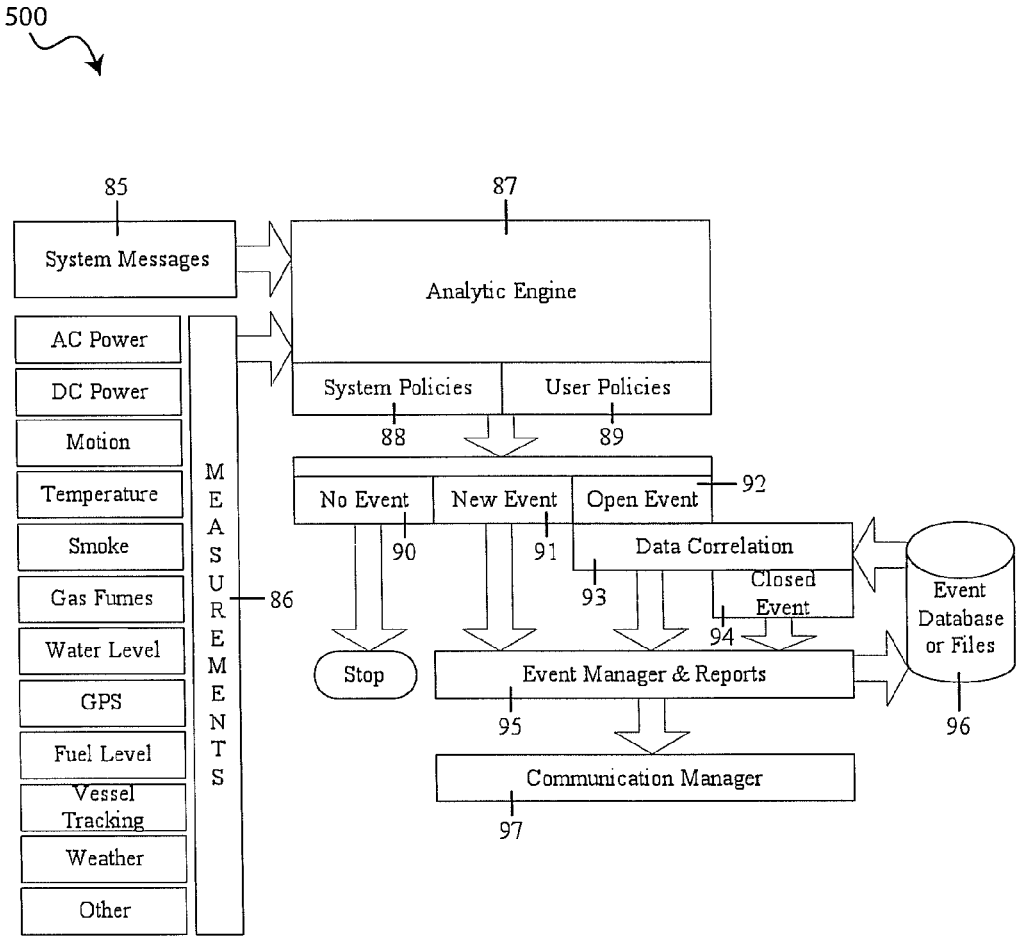
FIG. 8 is an exemplary diagram of a nautic alert analytic engine and analysis process model.

FIG. 8 illustrates the analysis process model 500 and analytic engine 87 used within system application 29 in conjunction with the wired and wireless intelligent sensors and devices. Analytic engine 87 may be configured to eliminate false-positive messages, to aid in information reporting, and to promote proactive behavior that helps to mitigate specific disasters and events. Therefore, system 160 can be an intelligent system that can utilize an analytic engine 87 to perform analysis of inputs such as system messages 85, sensor data points, and sensor measurements 86. System 160 may analyze such inputs against system policies 88 and user-defined policies 89 and may thereby determine whether there is currently "no event" 90, whether a "new event" 91 has occurred, or whether the current input is part of an "open event" 92 that supports keeping the event open or supports closing the event. When analytic engine 87 declares a new event 91, then event manager 95 may record the event to a database or to a set of files 96 and may notify the communication manager 97. When the analytic engine 87 declares an input as part of an open event 92, analytic engine 87 may perform data correlation 93, if applicable, to determine whether the input supports declaring a closed event 94. If so, the event may be closed and the event manager 95 may record the closure by updating the database or set of files 96 and may further notify communication manager 97. Conversely, if the input does not support declaring a closed event 94, the event manager 95 may record the input as part of an open event, may update the database or set of files 96 and may further notify the communication manager 97.

Turning back to FIG. 4, system 160 may be equipped with a GPS receiver 26 and a soft GPS sensor 42 that can capture navigation data such as longitude, latitude, speed, heading, and altitude for the vessel. GPS receiver 26 and soft GPS sensor 42, may be for example, integrated into the cabin of the boat or vessel, provided in an external antenna, a wireless system or the like. By capturing these data points along with other data and applying appropriate algorithms, system 160 may monitor for anchor slippage when a vessel is anchored. If soft GPS sensor 42 detects a change in drift distance and angle that violates user-defined policies and thresholds, system 160 may alert the vessel owner or other targeted recipients using multiple options as defined under the policies of communication manager logic 36.

When a vessel is moored offshore or docked in a marina, if the vessel is moved from its location, soft GPS sensor 42 may detect the change and system 160 may alert the vessel owner, marina harbormaster, service provider, or other targeted recipients, using multiple options as defined under the communication manager logic 36 policies, that the vessel may have moved unexpectedly from its port, and may further provide current location information. System 160 may also allow for GPS stabilization on cold resets or normalized distance calculations that may prevent location outlier readings from generating false positives. Thus, system 160 may prevent false positive readings due to natural environmental factors that influence the GPS's accuracy or false positives that may occur due to poor GPS readings, for example, in remote areas of the globe.

Turning now to FIG. 5, system application 29 may further include vessel tracking logic service module 45, which can interact with soft GPS sensor logic 42 service module. Such interaction may include, but is not limited to, creating the following capability, functionality, and data points: (1) tracking the course of a vessel, destination, and originating location; (2) tracking travel time, longitude, latitude, speed, and heading between the origination point, the final destination point, and points therebetween; and (3) tracking past routes or courses that a vessel traveled.

System application 29 may include fuel level sensor logic 49 service module, which can obtain periodic measurements of a vessel's fuel level in coordination with vessel tracking logic 45 service module and maps and weather logic 50 service module. All included service modules can provide and send information to analytic engine 87 for process analysis as shown in FIG. 8. As an illustrative example, an owner of a fleet of vessels can review various online reports to protect against fuel theft, to measure efficiency, to manage costs, and for other goals and objectives. Analysis of said information by a vessel owner can be further enhanced by factoring additional variables such as weight, weather, tide, and water current information to determine impact on fuel consumption.

System console 200 may further include the capability and functional ability to display, via touch-screen 2, online nautical and standard maps and weather information as part of the map and weather logic 50 service module. Such ability to stream internet based online nautical and standard maps may eliminate the need for specific geographic location memory cards and the need to perform periodic system library updates. A map image of the vessel's current location can be downloaded and buffered such that the geo-fence representation can be overlaid on the map, and the map layers can be animated, thus reducing the need for additional map downloads. Additionally, the online weather information capability may reduce the need for bulky and expensive radar rendering equipment commonly found on an onboard weather device.

System 160, when in away operating mode 7, may detect bodily movement in the cabin with integrated motion detection sensors 11, 13. System 160 may also include a wireless motion detector sensor for additional compartments. At detection, system 160 may initiate and send an alert to the vessel owner, marina harbormaster, service provider, or other targeted recipients using multiple options as defined under the communication manager logic 36 policies. System 160 may also initiate an audio alert via siren 4 of console 200. System may further have a deactivation feature using the boat owner's cell phone. That is, away operating mode 7 may be deactivated or changed via the vessel owner's cell phone, for example by issuing an SMS text message to system console 200. The cell phone can further be used, for example and not limited to hereto, maintenance of the boat by being able to remotely arm, disarm or otherwise change the operating mode 7 of system console 200. Such SMS text message interface capability may also be used, for example, to query the vessel's coordinates, to reset alerts, to get system information, and to access or modify other functions of console 200 directly, without requiring a subscription and without utilization of a central facility. The SMS text message interface may be limited to phone numbers that have been preregistered with the console 200 so that security attacks from non-trusted phones may be prevented.

System console 200 may include an integrated camera/video unit 12 and microphone 8 that are configured to capture a still picture of the surrounding area or to capture video with sound of the surrounding area. Such visual data may be used for security purposes, management purposes, surveillance, and for video conferencing, as illustrative, non-limiting examples. Microphone 8 can be used alone so as to capture voice for intercom services or for two-way telephone conversations. The functionality associated with pictures, video, and sound can be supported and enabled by system application 29 and by video and sound logic 40 service module.

System 160 may monitor power with integrated (wired) and wireless sensors, and, to that end, may utilize power management logic 39 and power sensor logic 41. The categories for power monitoring and detection may include at least: primary DC power interface 23; shore AC power interface 28; backup battery power 27, vessel DC power for a first battery bank 103; vessel DC power for a second battery bank 105; and Nautic Alert intelligent wireless device power interfaces. If power management logic 39 or analytic engine 87 detect the loss of AC power, a critical reduction in the vessel's DC voltage, or a power risk for the continuous operation of the vessel's power system or of system 160, system 160 may alert the boat owner, marina harbor-master, service provider, or other targeted recipients using multiple options as defined under the communication manager logic 36 policies. Communication manager logic 36 policies can be derived from user policies 89; therefore, the boat owner or user may decide, for example, the point at which the voltage level would generate an alert, as well as detected conditions for charging or discharging battery states.

System 160 may detect gas fumes in a designated vessel compartment. System 160 detects an irregular level of fumes, it may alert the boat owner, marina harbormaster, service provider, or other targeted recipients using multiple options as defined under communication manager logic 36 policies.

Figure 9:
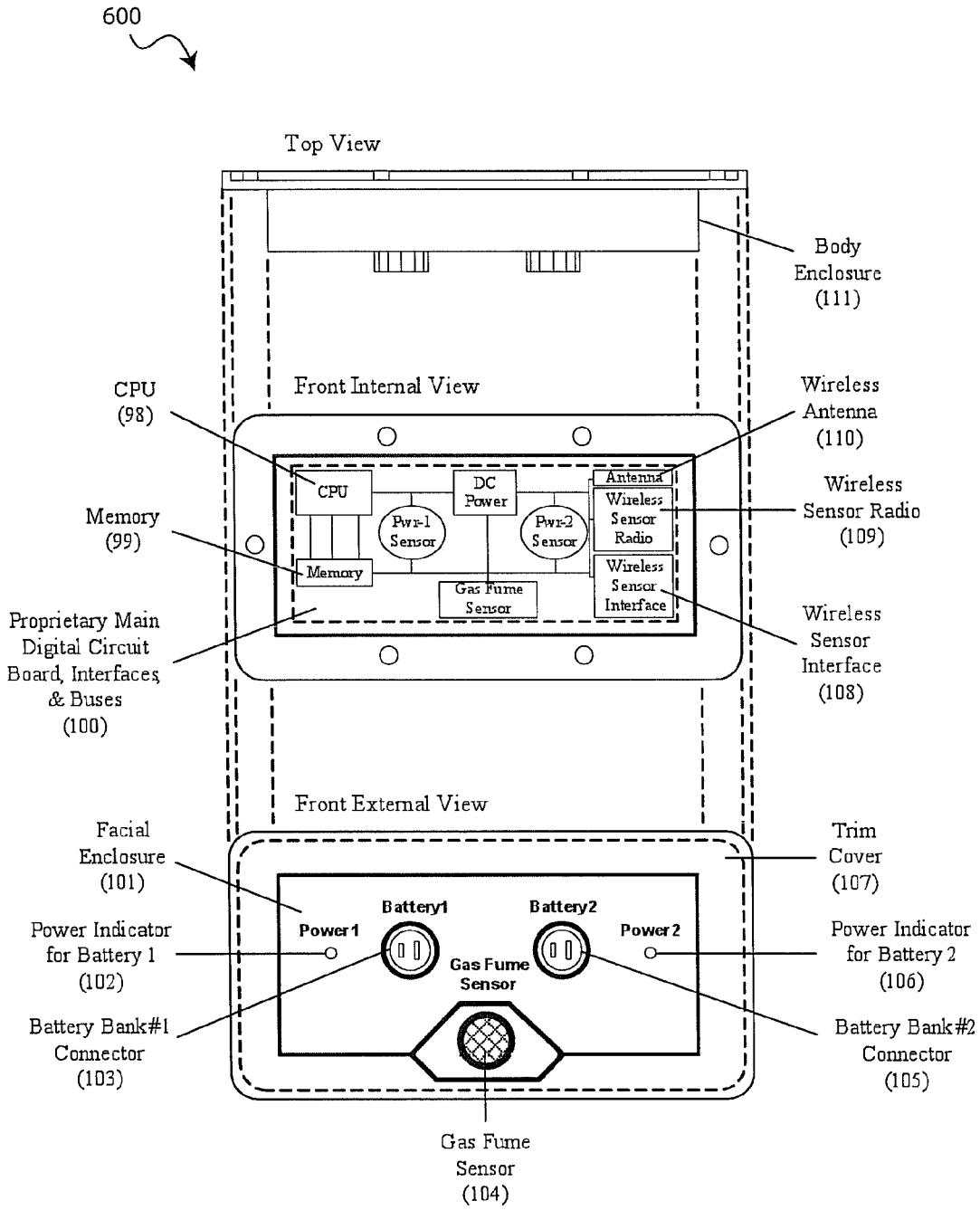
FIG. 9 is an exemplary diagram of a nautic alert intelligent wireless DC power and gas fume sensor unit.

Turning to FIG. 9, system 160 may include an intelligent wireless DC power and gas fume sensor unit 600. Unit 600 may include a body enclosure 111, a facial enclosure 101, and a trim cover 107 to conceal mounting fasteners. The front of unit 600 may include battery bank connectors 103, 105 and power indicators 102, 106, to facilitate connecting up to two separate DC main power sources, which can serve as inputs to be measured and monitored by unit 600. The front of unit 600 may also include a gas fume sensor 104 that can be used to measure gas fume levels for a desired area. During operation, inputs from battery connectors 103, 105 and gas fume sensor 104 can be captured through main digital circuit board, interfaces, and buses 100 by remote application logic 83, which may reside in memory 99 of unit 600. The resulting instructions from remote application logic 83 may then be processed by CPU 98. Wireless sensor layer 84 may then communicate with operating system hardware layer 75 via wireless sensor interface 108, wireless sensor radio 109, and wireless antenna 110. In hardware layer 75, wireless sensor coordinator/controller 18 and coordinator custom logic service module 52 can interact with operating system kernel layer 58, resulting in application-level communication with power sensor logic 41 service module and gas fume sensor logic 46 service module of system application 29. The inputs received by power sensor logic 41 service module and gas fume sensor logic 46 service module can then be utilized by analytic engine 87 for analysis processing, per the analysis process model 500 shown in FIG. 8.

System 160 may detect changes in water level from the boat owner's defined base using a sensor, for example a wireless ultrasonic sensor. In addition to being able to detect against a pre-determined threshold, this sensor may send additional alerts if the measured water level continues to rise, for example, due to reasons like a clogged water drain pipe, a failed bilge pump, a leaky thru hull fitting, or a water leak greater than the bilge pump capacity. Changes in water level may be measured and detected at less than one inch with the use of sound waves. Changes in water level may be evaluated against the boat owner threshold and reported according to certain policies. Alerts may be sent to the boat owner, marina harbor-master, or service provider using multiple options as defined under communication manager logic 36 policies.

Figure 10:
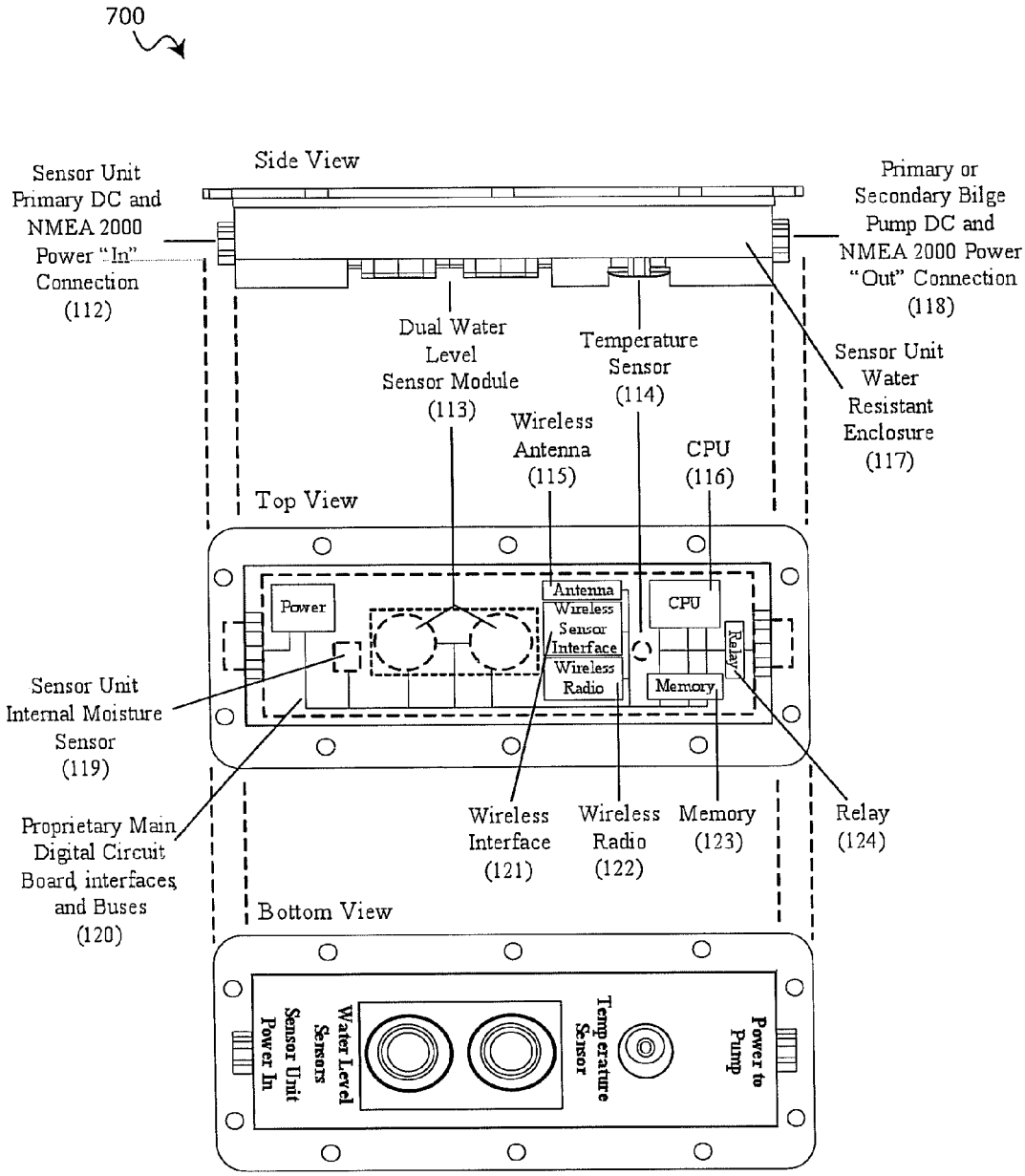
FIG. 10 is an exemplary diagram of a nautic alert intelligent wireless ultrasonic water level and temperature sensor and switch unit.

Turning to FIG. 10, system 160 may include an intelligent wireless ultrasonic water level and temperature sensor and switch unit 700. Unit 700 may include a water-resistant enclosure 117 and a DC and NMEA 2000 power in connector 112 to facilitate providing power to unit 700 from a DC power source that may be aboard the vessel. Unit 700 may further include an internal moisture sensor 119 that can facilitate measuring moisture levels within enclosure 117. Such measuring of moisture levels may be a proactive process facilitated and managed by ultrasonic water sensor logic 48 service module to so as to increase reliability and performance levels.

Unit 700 may further include a waterproof dual ultrasonic (sonar) water level sensor module 113 and a waterproof temperature sensor 114. Ultrasonic water level sensor module may include dual ultrasonic sensors so as to provide redundancy in the case of sensor failure. The front of unit 700 may be positioned over a desired area that can contain water or liquid, and may further be positioned so as to expose ultrasonic water level sensor module 113 and temperature sensor 114 to the desired area. The ultrasonic water level sensor module 113 may then emit a concentrated pulse of sound waves to the targeted surface area and subsequently can measure the length of time for the sound to be reflected back to sensor module 113. As the sound moves at a fast and constant speed, the distance to the targeted bottom surface and back can be calculated. The targeted bottom surface may represent an area with no liquid at the time in which the baseline is established; that is, the baseline may be equal to zero inches (or equivalent thereof in other measuring units). When liquid enters the targeted bottom surface area, the length of time for the sound to be reflected back to the said sensor module 113 can decrease due to the presence of liquid above the bottom surface. Sensor module 113 can then measure the change in time for the sound to reflect off the liquid surface within the targeted area and may calculate a change in level from a zero level to the new level in inches or other desired measuring units.

During operation, inputs from internal moisture sensor 119, ultrasonic water level sensor module 113, and waterproof temperature sensor 114 can be captured through the proprietary main digital circuit board, interfaces, and buses 120 by remote application logic 83, which may reside memory 123 of unit 700. The resulting instructions from remote application logic 83 mayt then be processed by CPU 116. Wireless sensor layer 84 may then communicate with operating system hardware layer 75 via wireless sensor interface 121, wireless sensor radio 122, and wireless antenna 115. In hardware layer 75, wireless sensor coordinator/controller 18 and coordinator custom logic 52 service module, can interact with operating system kernel layer 58, resulting in application level communication with ultrasonic water sensor logic 48 service module and temperature sensor logic 47 service module of system application 29. The inputs received by ultrasonic water sensor logic 48 service module and temperature sensor logic 47 service module can then be utilized by analytic engine 87 for analysis processing, per the analysis process model 500 shown in FIG. 8.

Unit 700 may include a connector 118 that is adapted for a primary or secondary bilge pump. Connector 118 may be a DC and NMEA 2000 power out connector, and may be configured to control the operation and the on/off state of a supported bilge pump. Unit 700 can be used as a bilge pump switch, and may thus replace the float switch for a bilge pump. Unit 700 may also be used as a switch to a secondary bilge pump and can utilize ultrasonic water level sensor 113 to measure the water level. The user may modify user policy 89 to set a desired "maximum" and "minimum" water level. When the water level reaches such a maximum level, the internal relay 124 of unit 700 can be closed, thereby allowing DC power to flow to the bilge pump. The bilge pump is thus turned on and can pump water out of the bilge area, until the ultrasonic (sonar) water level sensor module 113 measures a minimum lower water level that meets the predetermined user policy 89 based minimum level. Internal relay 124 may then be opened, turning off the bilge pump. Furthermore, with or without the use of the switch function illustrated in FIG. 10, the ultrasonic water level sensor module 113, in conjunction with remote application logic 83, can report to system console 200 and to system application 29 periodic water level measurements and bilge pump operating time. Such measurements may then be processed utilizing analytic engine 87 and analysis process model 500.

Ultrasonic water level sensor module 113 may check water level at least once per second so as to conserve power, and may be configured, via touch-screen 2 of console 200, to perform varying time checks. Unit 700 may also be able to recalibrate and zero-out a sensor reading on the fly. By default, the sensor may measure a set distance. Once the sensor has been installed, the zero-distance mark may reside inside of a distance range. For example, if the bilge normally has a ¼ inch of water present due to normal operations, the zero-distance mark will be at the top of the ¼ inch of water and any additional rise in level may be reported. Should the user want to adjust the zero-distance mark, the ultrasonic water level sensor module 113 may be recalibrated with a new zero-distance mark. The user may further utilize console 200 to restore product defaults so as to allow a vessel owner or installer to see how much additional space they have to work with before a sensor reading is registered, in the event the bilge height is greater than the maximum range distance detected by the sensor. This can allow the user to ascertain whether the sensor is mounted within a proper range.

Ultrasonic water level sensor module 113 may include two ultrasonic water level sensors for redundancy purposes, so that the failure of one sensor does not impede the operation of unit 700. Ultrasonic water sensor logic 48 of system application 29 may detect a failed ultrasonic sensor and can automatically modify the operation of unit 700 to operate on one ultrasonic sensor within the ultrasonic water level sensor module 113. An automatic modification due to an unexpected failed ultrasonic sensor may further result in a system message alert to the boat owner or user. In the case of ultrasonic sensor failure, or as otherwise may be desired, ultrasonic water level sensor module 113 can be replaced without replacing the entire unit 700.

System 160 may utilize integrated and wireless sensors to detect temperature that may be approaching or have reached freezing levels. The user may customize upper and lower temperature threshold settings for which alerts are sent. System 160 may alert the vessel owner of such temperature changes in each desired compartment or as an overall temperature warning in order to mitigate risk of damage to, for example, engine(s), water strainers, water lines, or thru hull fittings.

As shown in FIG. 10, intelligent wireless ultrasonic water level and temperature sensor and switch unit 700 may further include a temperature sensor 114, which can measure the temperature within a desired compartment area and can alert the vessel owner or other targeted recipients, as an illustrative example, of a potential freeze warning. The user can customize the upper and lower temperature threshold settings for which they wish to receive alerts via console 200.

System 160 may detect smoke caused by fire or burning of materials. If system 160 detects smoke, it may alert the boat owner, marina harbormaster, service provider, or other targeted recipients using multiple options as defined under the policies of communication manager logic 36.

Figure 11:
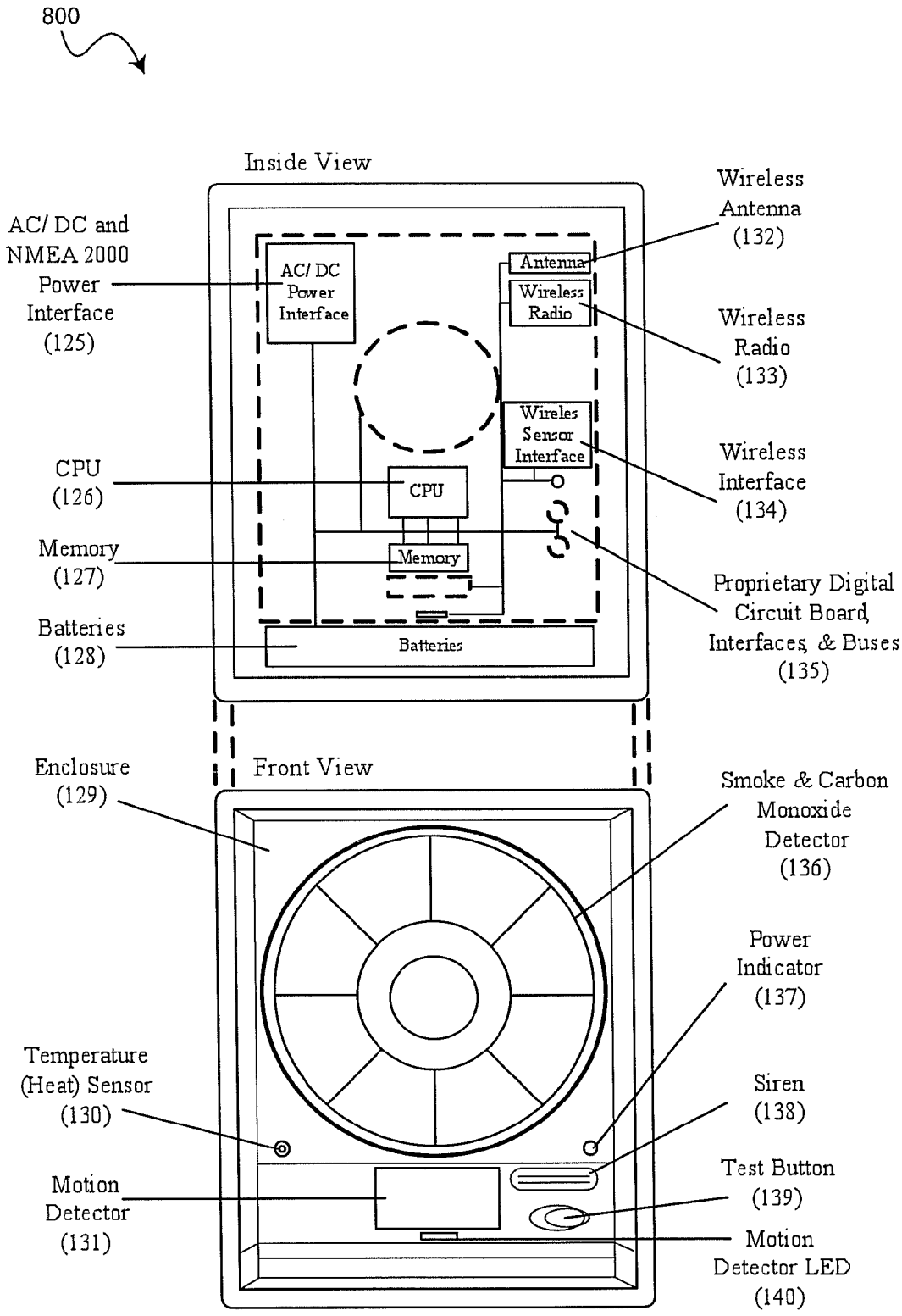
FIG. 11 is an exemplary diagram of a nautic alert intelligent wireless smoke detector, temperature, and motion detection sensor unit.

Turning to FIG. 11, system 160 may include an intelligent wireless smoke detector, temperature, and motion detection sensor unit 800. Unit 800 may include an enclosure 129, and may be powered with AC or DC power using the AC/DC and NMEA 2000 power interface 125, or may operate from standalone batteries 128. Unit 800 may also include an exposed temperature (heat) sensor 130, a smoke and carbon monoxide detector 136, a motion detector 131 with a LED indicator 140, a power indicator 137, a siren 138, and a user test button 139 for testing the system.

During operation, inputs from heat sensor 130, smoke and carbon monoxide detector 136, motion detector 131, and user test button 139 can be captured through the proprietary main digital circuit board, interfaces, and buses 135 by remote application logic 83, which may reside in memory 127 of unit 800. The resulting instructions from remote application logic 83 may then processed by the CPU 126. Wireless sensor layer 84 may then communicate with operating system hardware layer 75 via wireless sensor interface 134, wireless sensor radio 133, and wireless antenna 132. In hardware layer 75, wireless sensor coordinator/controller 18 and coordinator custom logic service module 52 can interact with operating system kernel layer 58, resulting in application-level communication with temperature sensor logic 47 service module, smoke sensor logic 44 service module, and motion sensor logic 43 service module of system application 29. Smoke sensor logic 44 may then apply appropriate algorithms to pre-test for a false-positive event. Inputs received by temperature sensor logic 47 service module, smoke sensor logic 44 service module, and motion sensor logic 43 service module from the remote application logic 83 can then be utilized by analytic engine 87 for analysis processing, per the analysis process model 500 shown in FIG. 8. Upon declaration of an event by analytic engine 87 and event manager 95, siren 138 may sound and an alert may be issued to the vessel owner and other targeted recipients, as defined by the policies of communication manager logic 36.

Figure 12:
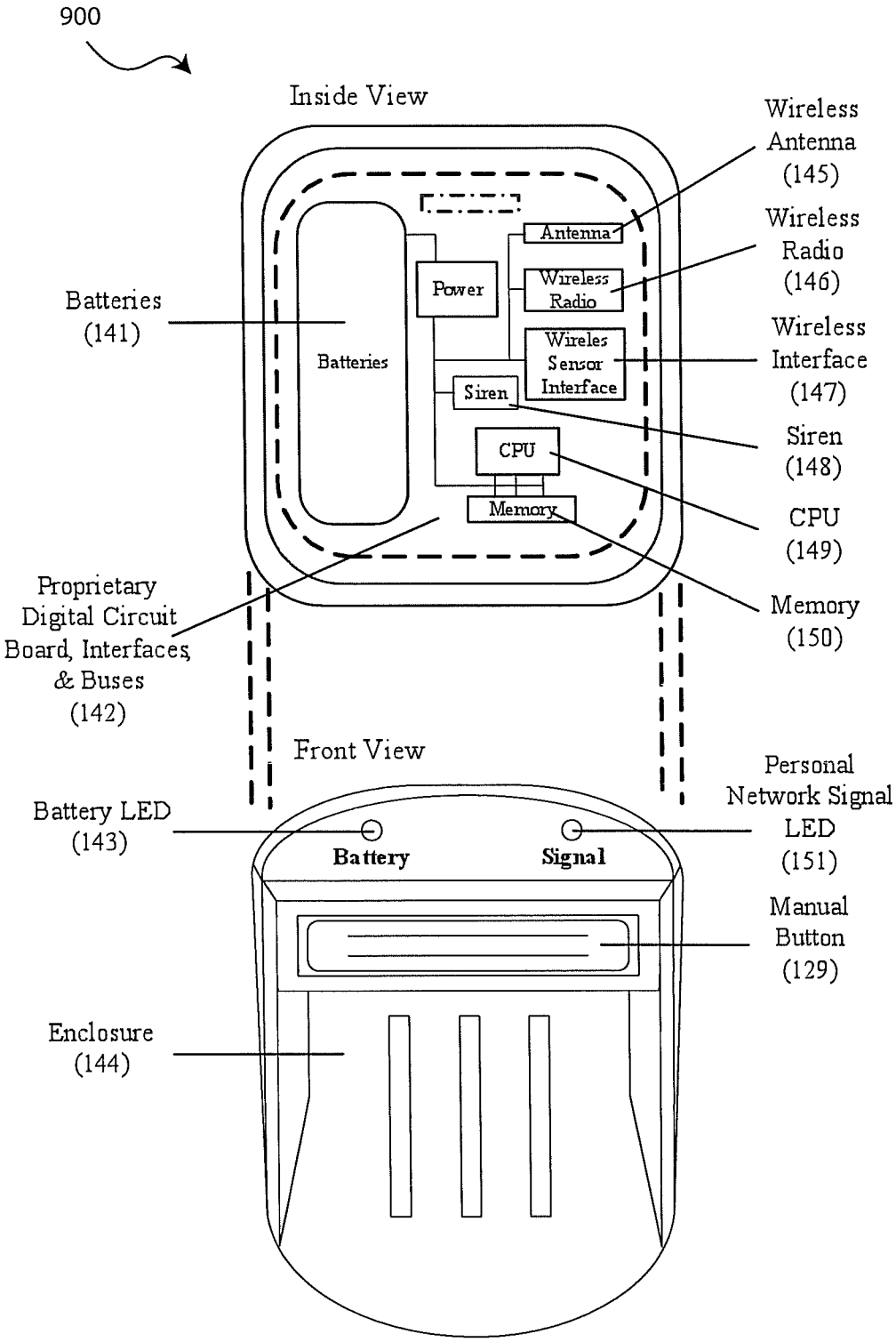
FIG. 12 is an exemplary diagram of a nautic alert personal emergency wireless unit.

Turning to FIG. 12, system 160 may include at least one personal emergency wireless unit 900. Unit 900 may provide an individual present on a vessel with a safety device that can be used, for example but not limited to, to provide a personal injury or disablement notification, or a notification of a passenger or crew member falling overboard from a vessel. Unit 900 may be portable and may be adapted to be coupled to the person of an individual present aboard the vessel. The notification may be issued by depressing manual button 129. In the event that an individual has fallen overboard from a vessel, the notification may be issued by depressing manual button 129, or may be issued automatically by unit 900, based on a diminution in the signal strength to the personal network 154 or by the loss of signal to personal network 154.

Nautic Alert personal emergency wireless unit 900 may include a body enclosure 144, a manual button 129, a battery level LED indicator 143 to facilitate monitoring the strength of installed replaceable batteries 141, and a network signal strength indicator 151. During operation, the activation of unit 900, whether via depressing manual switch 129, via reduced signal strength, or loss of signal to personal network 154, may be captured through proprietary main digital circuit board, interfaces, and buses 142 by remote application logic 83, which may reside in memory 150 of unit 900. Such activation can in turn activate siren 148. The resulting instructions from remote application logic 83 may then be processed by CPU 149. Wireless sensor layer 84 may then communicate with operating system hardware layer 75 via wireless sensor interface 147, wireless sensor radio 146, and wireless antenna 145. In hardware layer 75, wireless sensor coordinator/controller 18 and coordinator custom logic service module 52 can interact with operating system kernel layer 58, resulting in application-level communication with system application 29. The inputs received by system application 29 can then be utilized by analytic engine 87 for analysis processing, per the analysis process model 500 shown in FIG. 8. If analytic engine 87 and event manager 95 declare an event, siren 4 of console 200 may then emit high-pitched variable sounds, or any other desired alarm sound, and may display, on touch-screen 2, location information from soft GPS sensor logic 42 service module. An alert may further be issued to the vessel owner and targeted recipients, as defined by the policies of communication manager logic 36. Location information from soft GPS sensor logic 42 service module may be included within the policies of communication manager logic 36.

System application 29 may include sensor management logic 35, so as to enable a user to easily identify, add, and remove desired sensors and desired units from personal network 154. A user may utilize IGUI 32 of console 200 to view the sensors that are active in personal network 154, the status of the sensors, the alert settings and thresholds of the sensors, as well as the real-time data being provided by those sensors. The user may further identify and troubleshoot wireless issues by seeing real-time packet statistics, signal strengths, as well as whether or not a sensor has been detected as going offline, or never coming online since a system power-on event.

Sensor management features may include at least: (1) a manual ability to scan for new sensors and add them to personal network 154; (2) once sensors are added to the network, limiting the communications thereof only to the trusted Communication Manager; (3) online and offline sensor detection, wherein if a sensor unexpectedly drops offline or will not come online, error recovery may automatically initiate and rescan for a random clear channel to switch to (in the event another network may be operating within range on the same channel, this may allow the sensor network to self-correct to a clear channel); (4) ability to distinguish sensor instances through unique name; (5) ability to view firmware levels and (keep-alive) update rate; (6) ability to view sensor type, for example, long range or standard range; (7) ability to initiate alarm test to verify communication path and alert settings; (8) ability to disassociate a sensor from the network, and reset sensor into network discovery mode; (9) ability to enable or disable a sensor on the personal network; (10) ability to view sensor signal strength and real-time packet statistics for troubleshooting purposes; (11) ability to view all sensor types and online/offline status in a single window; (12) ability to see sensors with pending commands that are waiting to be sent; and (13) ability to provide a summary of sensor statuses using red, yellow, and green graphical indicators.

Safeguards may provide additional security measures for the wireless sensors. This may help prevent wireless communication issues, as well as rogue devices attempting to communicate within the personal network and compromise system security. System application 29 may include a plurality of safeguards, implemented via security management logic 38 service module, which can provide enhanced security measures for the wireless sensors and console 200. System application 29 may be configured to discriminate between genuine or authorized wireless sensors/devices and foreign wireless sensors/devices as a function of security management logic 38 service module. Such capabilities may facilitate reducing the likelihood of wireless communication issues, impeding rogue devices from attempting to communicate with and within personal network 154, and protecting the security of system 160 from being compromised.

Safeguards of the system may include at least: (1) security management logic 38 service module may generate a random network ID to reduce the likelihood of coexistence of two or more networks having the same network ID; (2) the ability to regenerate network ID and ability for networked sensors and units to auto-discover and bind to this change; (3) ability to view sensor firmware and sensor type, for example, long range/standard range; (4) the system may not communicate with non-trusted or foreign sensors; (5) ability to override channel assignment and prevent against channel scanning/hopping; and (6) physical layer wireless encryption.

System console 200 may also include password protection features. Recovery of a lost password may be accomplished by requesting the password via a button on the sign-on screen of IGUI 32. Upon request, the system can send the password to the vessel owner by email or as a text message. System application 29 can be configured so that access to console 200 can be granted based on an individual's role, such as "administrator" or "non-administrator". The individual's role may determine what modifications, if any, an individual can make to system application 29, and which application screens can be presented via IGUI 32 or allowed to be viewed on touch-screen 2 of console 200.

System application 29 may include an event management logic 37 service module, which can enable an event log. The event log may contain a log of events captured by analysis process model 500 over a period of time. The event log may contain a list of all reported events and non-reported events. This list may be saved in a non-volatile location, for example in a non-volatile location in console 200, such that it may be retrieved after complete power-loss is experienced. The event log may at least: (1) show when alert policy has changed and been reset; (2) show changes to sensors; (3) show online/offline/alert events that attempted to send remotely; (4) show password login-attempt failure events, as well as other miscellaneous events; (5) time stamp and dates all logged events; and (6) update event database as data points for portals.

Settings for system 160 may be customized, for example via IGUI 32 of console 200. Such customizable settings may include at least: (1) changing the language displayed in the IGUI; (2) Setting/enabling/disabling password settings; (3) choosing a password recovery contact; (4) setting time and date; (5) changing LCD brightness and power management controls; (6) setting measurement units; (7) setting user policies; and (8) changing personal information, such as, for example, marina, dock/pier, slip, address, and boat name.

System features may be activated or deactivated using the boat owner's cellular phone, Smartphone, PDA, PC, or Laptop. As an example, if a vessel owner is about to enter the cabin while motion sensor is currently active under the away mode, the vessel owner, using his or her cell phone, can dial into the system and submit a code to change the operating mode from "away" to "onboard" prior to entering the vessel's cabin. The vessel owner can thus avoid the generation of an entry event and related messages and the activation of siren 4.

Communication manager logic 36 can be a software component that may interact at the application logic 33 level. Communication manager logic 36 service module may be responsible for the at least the following: (1) alert policies; (2) sending alerts; and (3) alert recipient contacts. The communication manager logic 36 service module may utilize user-defined policies 89 to define alert policies to determine which events will generate alerts, when the alerts will be sent, how they will be sent, to whom the alert will be sent, and the repeated frequency for sending alerts. Alert policy management may be facilitated via the alert settings of user policies 89 which are configured by the boat owner.

System 160 may include a number of alert-related features including, but not limited to: (1) sending an alert indicator and audio sound to system console 200 and audio speaker 3 thereof, and/or sending the alert to the vessel owner and other targeted recipients using cellular communication; (2) specifying the number of repeat alert occurrences that should be sent or acknowledged locally based on time or number policy; (3) specifying what type of sensor events should be sent, for example, online, offline, alerts, or status events; (4) specifying sensor thresholds for sending alerts; (5) specifying a list of alert recipients; (6) setting a time delay for cabin exit; (7) setting individual sensor threshold settings; and (8) requiring critical messages to be confirmed by recipients.

System 160 may support bi-directional cellular communication. To protect the system from unauthorized callers and unauthorized connections, security management logic 38 may have a list of authorized phone numbers and authorized personal identification numbers (PINs) as part of the authentication process. System console 200 may contain an embedded Global System for Mobile (GSM) standard modem 20 and a Code Division Multiple Access (CDMA) modem 19 for direct wireless communication through existing service provider networks. To enable communication with certain provider networks, an active Subscriber Identity Module (SIM) may be used. System console 200 may provide user access to add or change a SIM. The Alert Application may provide the boat owner with SIM Management information so the system may communicate. System console 200 may also be configured to interface with satellite and wireless broadband provider equipment utilizing wireless interface 15. System 160 may further utilize operating system hardware layer 75 to seamlessly auto-switch between GSM modem 20, CDMA modem 19, wireless interface 15 to satellite, and wireless interface 15 to broadband by monitoring the connection availability, status, health, cost, priority order, and expected bandwidth load. Such functionality may be managed via system policies 88 and user policies 89.

Figure 1:
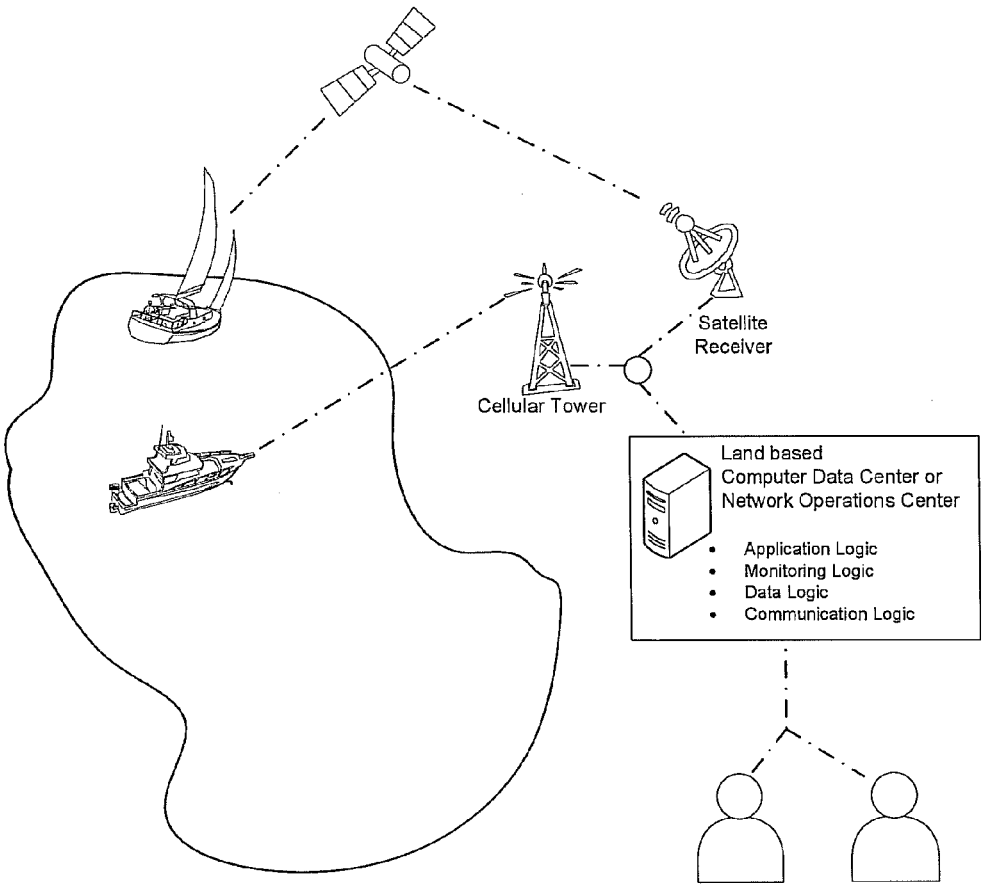
Fig. 1 (prior art)
FIG. 1 is an exemplary prior art land based dependency model for monitoring, data processing, and communication.
Figure 2:
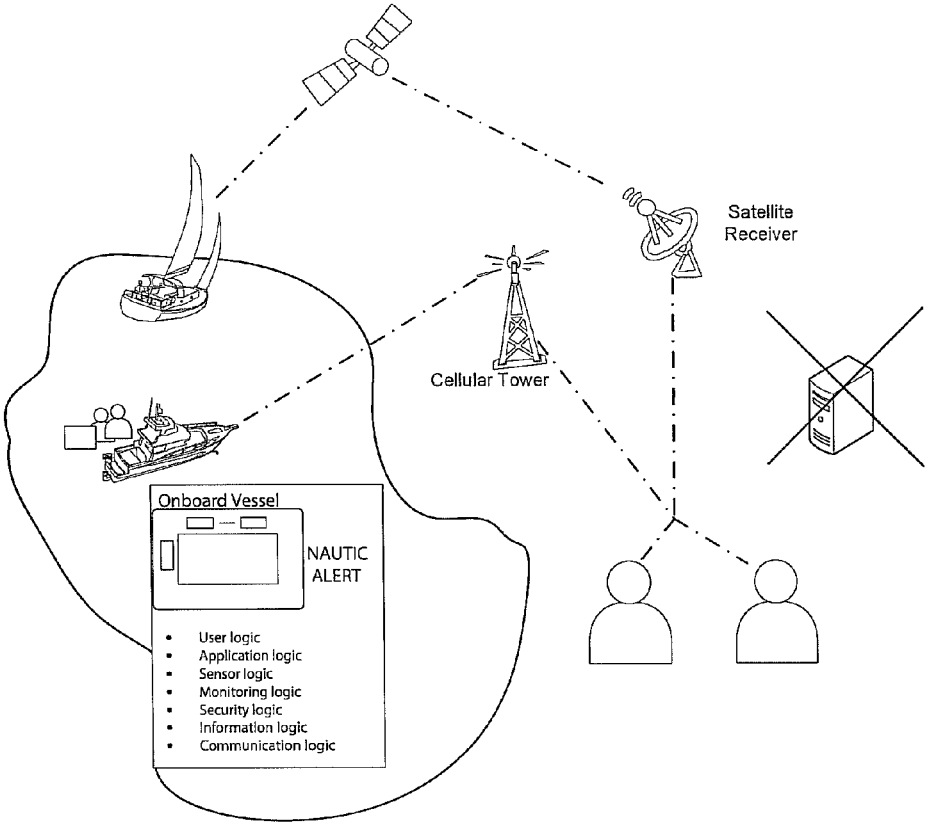
FIG. 2 is an exemplary nautic alert model for monitoring, information, and communication.

System 160, via system application 29, may have the ability to send alerts as email messages to the vessel owner's or other targeted recipients' email accounts. Email messages may be sent directly from the system console 200 to desired email accounts, as illustrated in FIG. 2. Thus, the need for a land-based central server is eliminated. Furthermore, security management logic 38 service module of system application 29 may encrypt email communications and may negotiate a secured connection for transmission of the encrypted email message using a Secured Socket Layer (SSL) protocol.

System application 29 may include a setup wizard 31 service module, which may be a component of IGUI 32. Setup wizard 31 may guide the end user through a non-technical setup process and enforce dependency rules to setup the system, and facilitate a simple and user-friendly interface and method for system setup. Conversely, system application 29 may be configured and managed at a granular, technical level, for example, by users that have specific requirements or a need for greater system visibility.

System application 29 may also include a help manager. The Help Manager may provide user help information within interactive steps and within configuration sections of the system application. The Help Manager may also explain what each indicator means, the purpose of each function, and the best practice for the use of each function.

From time to time, there may be a need to update the firmware of components of system 160 or of system application 29. To accomplish an update, there may be at least two methods: (1) updates may be accomplished by inserting a compliant USB storage device into system console 200 that contains authorized and approved system software; and (2) updates may be accomplished as a "push" from a server to a targeted system 160 using a "signed" company software image. Subsequently, in either case, system application 29 and security management logic 38 may then seek an electronically "signed" company software image on the USB device that certifies the said software image as authorized and approved for production distribution. The user may also be guided through the updating procedures via IGUI 32.

System 160 may provide at least four distinct portals that can allow the display of enhanced information, receive alerts, and enable two-way enhanced capabilities between system console 200 and a mobile device or remote computer. The portals may include, but are not limited to: (1) Mobile Portal—an application may run on a smartphone, PC, or laptop, which may provide a boat owner with a status dashboard, vessel location information, video and sound capability, historical data including courses traveled, trend information, and the ability to remotely change the configuration of system application 29 with approved security credentials; (2) Harbormaster Portal—A web-based application that may run on a PC or laptop that may provide a marina harbormaster with, for example, a red, yellow, or green graphical indicator for each vessel in the marina that has a system 160 onboard. The application may enable a marina management team to remain proactive about situations that may create a threat to a single vessel or to other vessels, property, and lives in the marina; (3) Service Provider Portal—a web-based application that may run within a three-tier architecture (the tiers including user presentation, application and database), providing a local or national monitoring service with, for example, a red, yellow, or green graphical indicator for each vessel with a system 160 that has subscribed for monitoring services such as a boat owner or an entire marina. The Service Provider Portal may enable the service provider to directly contact, for example, police, coast guard, medical or fire emergency team within seconds of a critical alert; and (4) Fleet Vessel Management Portal—a web-based "cloud" application that may provide a company with a fleet of vessels a view with enhanced reporting capability to aid, as an illustrative example, in enhanced vessel tracking capabilities, travel coordinates (longitude, latitude, heading), communications (including, for example, video conferencing), data exchange, fuel level consumption monitoring, travel time, correlation of information, fuel theft prevention, historical traveled courses, information to aid in the analysis of operating expense opportunities, and the ability to remotely change the configuration of the system application 29 with approved security credentials. System 160 may store data through event manager 37, and the data may interact with external web services, applications, and databases.

Figure 13:
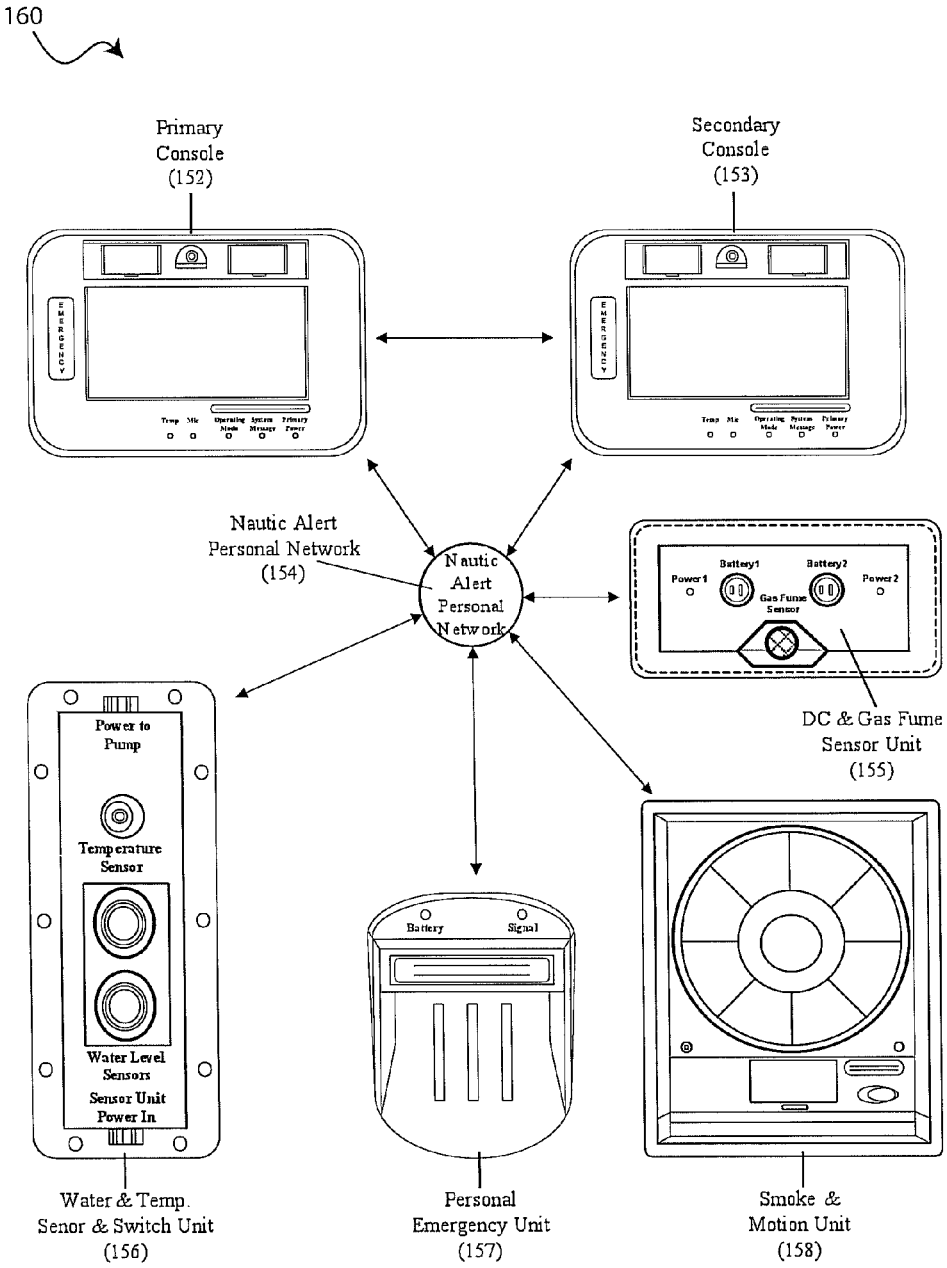
FIG. 13 is an exemplary diagram of a nautic alert distributed control system.

FIG. 13 shows an exemplary embodiment of a nautic alert system 160. System 160 may include primary console 152, secondary console 153, DC & gas fume sensor unit 155, water & temperature sensor & switch unit 156, personal emergency unit 157, and smoke & motion unit 158. Consoles 152, 153 and units 155, 156, 157, 158 may communicate via nautic alert personal network 154. Network 154 may be a wired or secured wireless local network.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An autonomous onboard monitoring and communications system for watercraft, comprising: a processor; at least one system console; a plurality of sensors configured to monitor operating and environmental conditions aboard the watercraft; a processor included in the system console, for hosting a system application; the system application comprising a plurality of software logic service modules configured to facilitate communication between the plurality of sensors and the system console; an analytic engine programmed to analyze input data including system messages indicating the status of systems aboard the watercraft, sensor data points and sensor measurements against at least one of a system policy and a user-defined policy so as to determine an existence of an event; and a plurality of communications interfaces for directly communicating with remote targeted recipients.

2. The system of claim 1, wherein the analytic engine is further configured to reduce the likelihood of false positive results.

3. The system of claim 1, wherein the plurality of sensors comprises one or more of: a temperature sensor, a DC power sensor, an AC power sensor, a motion sensor, a smoke sensor, a gas fume sensor, a water level sensor, and a GPS sensor.

4. The system of claim 3, wherein one or more of the plurality of sensors comprises a wireless interface.

5. The system of claim 1, further comprising a plurality of devices in communication with the service console.

6. The system of claim 5, wherein the system application is further configured to facilitate communication between the plurality of devices and the system console.

7. The system of claim 6, wherein the plurality of devices comprises one or more of: a camera, a touch-screen, a microphone, a speaker, a GSM modem, a CDMA modem, a satellite antenna, a WiFi antenna, a siren, a gas and fume sensor unit, a smoke and motion unit, a water and temperature sensor unit, and a personal emergency unit.

8. The system of claim 1, wherein the plurality of software logic service modules comprises one or more of: sensor management logic, communication management logic, event management logic, security management logic, power management logic, video and sound logic, power sensor logic, soft GPS sensor logic, motion sensor logic, smoke sensor logic, vessel tracking logic, gas fume logic, temperature sensor logic, ultrasonic water sensor logic, fuel level sensor logic, map and weather logic, remote application logic, coordinator custom logic, remote coordination logic, application programming interfaces, and device drivers.

9. The system of claim 1, wherein the console further comprises a printed circuit board comprising integrated memory and integrated buses.

10. The system of claim 1, wherein the console further comprises a power interface.

11. A method for autonomously monitoring operating and environmental conditions aboard a watercraft, comprising: utilizing a sensor to measure a condition and generate a sensor output; facilitating communication between the sensor and a system console; analyzing the sensor output by an analytic engine against at least one of a system policy and a user-defined policy so as to determine an existence of an event; and communicating the existence of the event directly to a recipient, wherein analyzing the sensor output by an analytic engine so as to determine the existence of an event further comprises analyzing system messages indicating the status of systems aboard the watercraft, sensor data points, and sensor messages.

12. The method of claim 11, further comprising reducing the likelihood of false positive results.

13. The method of claim 11, wherein the sensor is one or more of: a temperature sensor, a DC power sensor, an AC power sensor, a motion sensor, a smoke sensor, a gas fume sensor, a water level sensor, and a GPS sensor.

14. The method of claim 11, wherein the sensor is a wireless sensor.

* * * * *